US005522547A

United States Patent [19]

Dobbs et al.

[11] Patent Number: 5,522,547

[45] Date of Patent: Jun. 4, 1996

[54] SPRAYER HAVING PRESSURE BUILD-UP DISCHARGE

[75] Inventors: Douglas B. Dobbs, Yorba Linda; James R. Gillingham, Hacienda Heights; Adonis K. Spathias, Corona, all of Calif.

[73] Assignee: Calmar Inc., City of Industry, Calif.

[21] Appl. No.: 331,749

[22] Filed: Oct. 31, 1994

[51] Int. Cl.[6] ..... B05B 9/43; B05B 1/34

[52] U.S. Cl. ..... 239/333; 239/493

[58] Field of Search ..... 239/333, 463, 239/491–494

[56] References Cited

U.S. PATENT DOCUMENTS

| | | | |
|---|---|---|---|
| 3,061,202 | 10/1962 | Tyler | 239/333 |
| 4,051,983 | 10/1977 | Anderson | 222/321.4 |
| 4,273,290 | 6/1981 | Quinn | 239/493 |
| 4,365,751 | 12/1982 | Saito et al. | 239/333 |
| 4,624,413 | 11/1986 | Corsette | 222/383.1 X |
| 4,678,123 | 7/1987 | Klaeger | 239/492 X |
| 4,815,663 | 3/1989 | Tada et al. | 239/333 |
| 4,826,052 | 5/1989 | Micallef | 222/321.8 |
| 4,989,790 | 2/1991 | Martin et al. | 239/483 |
| 5,114,052 | 5/1992 | Tiramani et al. | 222/207 |
| 5,234,166 | 8/1993 | Foster et al. | 239/333 |
| 5,303,867 | 4/1994 | Peterson | 222/383.1 X |
| 5,423,460 | 6/1995 | Thomann | 239/333 X |

FOREIGN PATENT DOCUMENTS

| | | | |
|---|---|---|---|
| 5-104040 | 4/1993 | Japan | 239/333 |
| 199479 | 11/1965 | Sweden | 239/333 |
| 2143286 | 2/1985 | United Kingdom | 239/333 |
| WO92/04128 | 3/1992 | WIPO | 239/333 |

*Primary Examiner*—Andres Kashnikow
*Assistant Examiner*—Lesley D. Morris
*Attorney, Agent, or Firm*—Watson Cole Stevens Davis

[57] ABSTRACT

A two stage pressure build-up discharge valve assembly is mounted within the end of the discharge nozzle surrounded by a nozzle cap of a trigger actuated pump sprayer, and includes a spring biased discharge valve element having a high pressure throttle valve fixed to a second stage low pressure valve piston to provide a predetermined pressure threshold which when exceeded by fluid pressure generated by the pumping force applied during trigger actuation unseats immediately permitting the fluid pressure to act upon the low pressure secondary valve piston rapidly snapping the valve element to a full open flow position.

17 Claims, 1 Drawing Sheet

SPRAYER HAVING PRESSURE BUILD-UP DISCHARGE

BACKGROUND OF THE INVENTION

This invention relates generally to a fluid discharge valve assembly located at the fluid discharge nozzle end of a pump sprayer which may he trigger actuated, and more particularly to a two-stage pressure build-up discharge valve assembly for regulating the operator's pumping stroke velocity to thereby effect a well defined spray particle size and distribution range of fluid spray out of the discharge orifice.

Many known pump sprayers have discharge valves at the nozzle end of the discharge passage for throttle valving the fluid pressure during pumping. Such discharge valve forms part of an assembly including a spinner probe having spin mechanics of some type to effect a spinning or swirling action of the pressurized fluid to produce a spray discharge out of the orifice. Resilient means in the form of a separate coil spring or an integral plastic molded spring is provided for urging the valve into its seated position. The valve opens in response to fluid pressure in the discharge passage which exceeds the closing force of the spring.

Such known sprayer discharge valves are typically of the throttling type which permit the operator to control the actuation rate of the trigger sprayer, which actuation rate determines the flow velocity. The flow velocity through the spin mechanics determines the size of the spray plume or more precisely the rotational velocity of the annular fluid sheet exiting from the orifice. The greater the velocity (the more energy in the spray plume) the thinner the annular sheet and the finer the particles created by breakup in the atmosphere. Thus the operator's pumping stroke rate varies the size and distribution range of the spray particles.

New product formulations require a narrow distribution range of particles and a predicted mean particle size.

SUMMARY OF THE INVENTION

It is therefore an object of the present invention to provide discharge valving at the nozzle end of a trigger pump sprayer for effectively regulating the operator's pumping stroke velocity and thereby produce a well defined and improved particle size and distribution range of fluid issuing from the discharge orifice as a fine mist spray.

This general objective is achieved by the provision of a two-stage pressure build-up discharge valve assembly mounted at the end of the discharge nozzle surrounded by a nozzle cap. A spring loaded high pressure throttle valve is integrally connected with a second stage low pressure sliding piston valve. The two stage valve member provides a predetermined pressure threshold (PI) which when exceeded by fluid pressure generated by the operator's finger force on the trigger actuator opens immediately permitting the fluid pressure to act upon the low pressure secondary valve piston abruptly snapping the valve assembly to a fully open flow position. At such position the operator's fingers are effectively caused to travel all or through most of the pump actuation stroke distance before the finger muscles can compensate and adjust to the lower force permitted by the second stage valve piston. However, when the finger muscles adjust to the lower actuation force and relax, the spring abruptly snaps the two-stage valve closed at a predetermined pressure (P2).

At both the beginning of the pumping pressure stroke and at the end of pumping actuation, the two-stage valve snaps open and snaps closed immediately thereby eliminating the formation of large droplets at the beginning and at the end of each pressure stroke.

The primary advantage according to the invention is that the pump effectively regulates the operator's stroke rate thus causing the pressure through the spin mechanics to be constant between the beginning and the end of the pumping stroke resulting in a constant flow rate which controls the size of the spray plume and the size of the fluid particles formed as the annular sheet spray plume breaks up in the atmosphere. More importantly, the constant flow rate generates a narrow, repeatable range of spray particle size.

In accordance with the invention, the discharge valve member is movable within a valve seat member forming a valve seat for the high pressure throttle valve and a cylinder for the low pressure piston valve in sealing engagement with the sidewall thereof so as to therewith define a variable volume chamber.

The spring loaded throttle or poppet valve has a pressure reaction surface smaller than that of the piston valve to provide a predetermined pressure threshold (P1) which when exceeded by fluid pressure generated by the operator's finger force applied to the trigger actuator results in a large pressure drop in immediately unseating the poppet valve permitting fluid pressure to act upon the valve piston rapidly snapping the valve assembly to a fully open flow position. When the finger muscles adjust to the lower actuation force permitted by the second stage valve piston, the spring immediately snaps the valve closed at a predetermined pressure (P2).

The improved spray quality likewise enhances the quality of foaming (such as uniform bubble formation) with the provision of a foam generator at the downstream end of the nozzle cap.

Other objects, advantages and novel features of the invention will become more apparent from the following detailed description of the invention when taken in conjunction with the accompanying drawings.

DESCRIPTION OF THE PREFERRED EMBODIMENT

Figure 1:
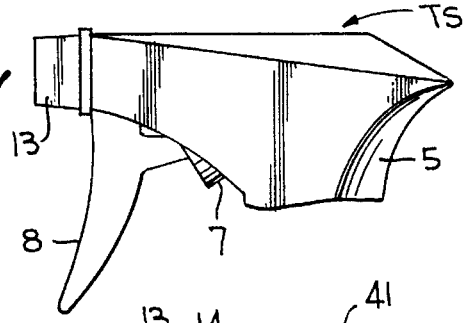
FIG. 1 is a side elevational view of part of a trigger sprayer embodying the invention.

Turning now to the drawings wherein like reference characters refer to like and corresponding parts throughout the several views, a trigger sprayer TS is shown in FIG. 1 having a shroud cover 5 and a trigger actuator 8 pivotally mounted in any normal manner to the pump body for reciprocation of a pump piston within pump cylinder 7 upon manual actuation of the trigger.

Figure 2:
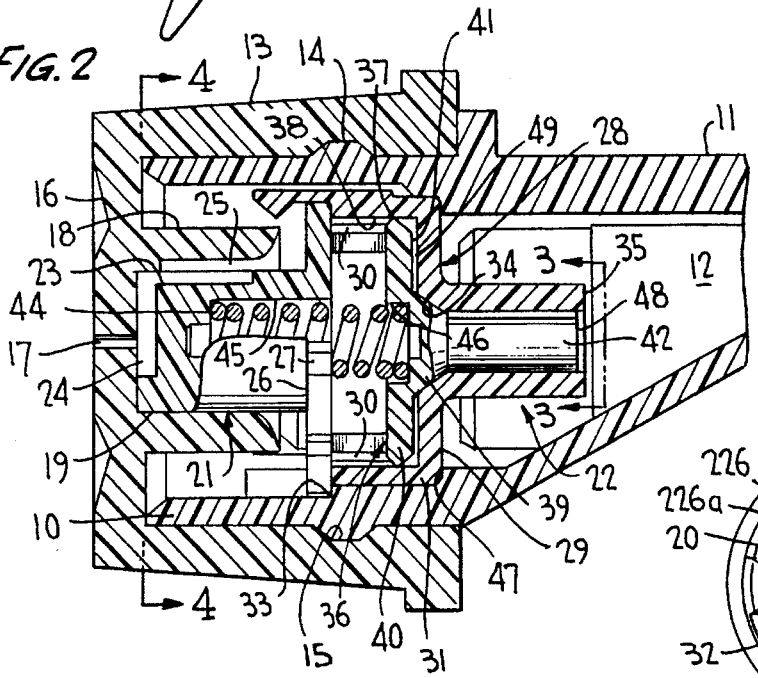
FIG. 2 is a vertical sectional view, at an enlarged scale, showing the details of the invention.

As detailed in FIG. 2, the trigger sprayer has a nozzle 10 at the end of a tubular outlet conduit 11 forming a discharge passage 12 through which liquid product is adapted to pass during the pumping operation. A nozzle cap 13 is externally mounted on the nozzle end of the outlet member by a snap fit produced between an external rib 14 and an internal groove 15 of the nozzle cap.

The nozzle cap may have a rectangular external configuration or may otherwise have flat surfaces to facilitate manual rotation of the cap about the nozzle between OFF and SPRAY positions.

The nozzle cap has an end wall 16 containing a central discharge orifice 17 coaxial with the discharge nozzle, and a coaxial, internal cylindrical skirt 18 which snugly engages the peripheral wall of a probe 19 of a spinner probe member 21 forming part of a fluid discharge valve assembly 22 to which the present invention is directed.

The spin mechanics provided for inducing a spin or swirl of pumped liquid directed into the discharge nozzle to issue as a spray through the discharge orifice may be similar to that disclosed in U.S. Pat. No. 4,706,888, commonly owned herewith. For example, the probe has a plurality of equally spaced longitudinal grooves 23 communicating with a central depression in the probe end wall forming a swirl chamber 24 having tangentials 20 (FIG. 4) extending between grooves 23 and the swirl chamber. Passages 25 are formed in the inner peripheral wall of skirt 18 such that upon rotation of the nozzle cap relative to assembly 22 the pump sprayer may be adjusted between OFF-SPRAY and SPRAY-OFF positions upon respective quarter turns of the nozzle cap.

Figure 4:
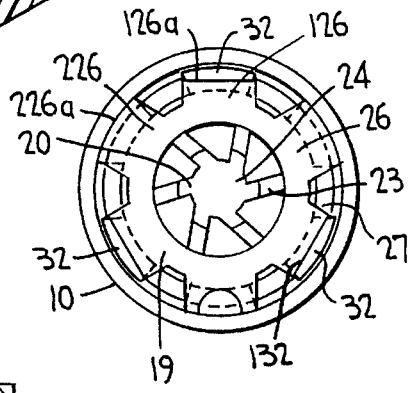
FIG. 4 is a view taken substantially along the line 4—4 of FIG. 2 with the nozzle cap not being shown in section in the interest of clarity.

Spinner probe member 21 has an interrupted base flange 26 with a plurality of notches 27 located in its outer periphery, as best seen in FIG. 4, to provide liquid communication passages to probe 19 and its spin mechanics from the outlet passage through the valve assembly. Flange 26 defines a plurality of equally spaced legs 126 having flat outer edges 126*a*, and a plurality of intervening equally spaced legs 226 of slightly longer radial extent having rounded end edges 226*a*.

Assembly 22 includes a valve seat member 28 which is essentially cup-shaped, having an end wall 29 and a cylindrical sidewall 31. A plurality of spring legs 32 extend from sidewall 31, presenting a shoulder 33 against which legs 126 and 226 of flange 26 bear when snap-fitted in place against the valve seat member. Edges 226*a* of legs 226 bear against the inner wall of nozzle 10, and flat edges 126*a* of legs 126 bear against inner flat walls 132 of spring legs 32. The interengagement between flat edges 126*a* and flat walls 132 resist rotation of spinner probe member 21 upon relative cap rotation about its axis.

End wall 29 of the valve seat member has a central opening defining a conical valve seat 34 from which a hollow guide sleeve 35 extends in an upstream direction.

Valve assembly 22 further includes a sliding discharge valve element 36 which may be in the form of a flat circular plate forming a low pressure secondary valve piston 40 having a feathered peripheral edge 37 in sliding sealing engagement with inner surface 38 of sidewall 31.

Valve element 36 has integrally formed thereon, or otherwise fixed thereto, a coaxial throttle valve or poppet 39 which may be part spherical or shaped in the form of a truncated cone and which, in the discharge closed position of FIG. 2, is seated fluid tightly against valve seat 34. And, the throttle valve, in the FIG. 2 position, may be formed to maintain valve piston 40 spaced from end wall 29 to therewith define a variable volume pressure chandler 41. Otherwise, the poppet valve may be so formed as to permit the valve piston to contact end wall 29 in the valve closed position of FIG. 2.

Figure 3:
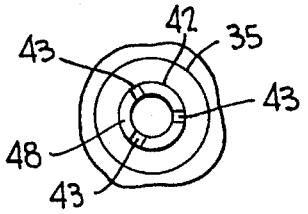
FIG. 3 is a view taken substantially along the line 3—3 of FIG. 2.

The poppet valve has an extension in the form of a short rod 42 projecting into sleeve 35, the extension being formed at its outer periphery with a plurality of longitudinally extending grooves 43, best seen in FIG. 3.

Assembly 22 likewise includes resilient means which may be in the form of a coil spring 44 for resiliently urging valve element 36 into its valve closed position of FIG. 2. Probe member 21 has a central depression 45 providing a seat for one end of spring 44, and valve element 36 has an opposing depression 46 forming a seat for the opposite end of the spring.

Cup-shaped valve seat member 28 is sized as to permit a tight friction fit within nozzle 10 formed to provide a shoulder 47 against which end wall 29 bears to prevent axial displacement of the assembly. And, the entire fluid discharge valve assembly 22, which may form a subassembly, is mounted in place within the nozzle and is surrounded by nozzle cap 13 when snapped in place.

End surface 48 of the extension of the valve body (or the end surface of the throttle valve without extension 42) presents a pressure reaction surface to the incoming flow of pressurized liquid in outlet passage 12. End surface 49 of valve piston 40, which likewise defines a pressure reaction surface to the incoming flow of fluid under pressure in passage 12, has a surface area larger than the area of end surface 48.

In setting the minimum operating pressure, provision is made to effect a high pressure drop across the valve. This is achieved by providing a small end surface 48 area (plus the exposed area of that portion of the poppet valve surface at the root end of grooves 43) for the incoming fluid under pressure to press against. The spring loaded throttle valve is thus referred to as a high pressure valve (pressure times area equals the force spring 44 must oppose) which provides a predetermined pressure threshold (P1) which when exceeded by pressure generated by the operator's finger force on trigger actuator 8 opens immediately permitting the fluid pressure to act upon valve piston 40 rapidly snapping the valve element 36 to a fully open flow position. Once the valve is open, it is desirable for the pressure drop to be very low so that the pressure across the nozzle orifice is at a maximum. This is achieved by providing a large area of end surface 49 for the fluid to press against. Hence valve piston 40 is a second stage low pressure valve (large area, large force, small pressure drop).

In operation, the valve according to the invention effectively switches between these two regimes. When closed and not under pressure spring 44 maintains poppet valve 39 seated against its valve seat 34 and presents a predetermined pressure threshold (P1). When P1 is exceeded by fluid pressure in passage 12 as generated by the operator's finger force on trigger 8, the high pressure throttle valve 39 unseats immediately permitting the fluid pressure to act upon the low pressure secondary valve piston 40 rapidly snapping valve element 36 to a fully open flow position as the valve element shifts to its FIG. 5 position.

Notches 30 are provided in sidewall 31 spaced a predetermined distance from end wall 29 for breaking the seal between valve piston 40 and member 28 and hence permit the full flow of fluid through the valve member. In the discharge open position of FIG. 5, liquid product under pressure is abruptly released from chamber 41 and is discharged through the discharge orifice via notches 30, notches 27 and through the spin mechanics where the liquid is swirled so as to issue as a fine mist spray of uniform spray particle size and spray velocity.

Figure 5:
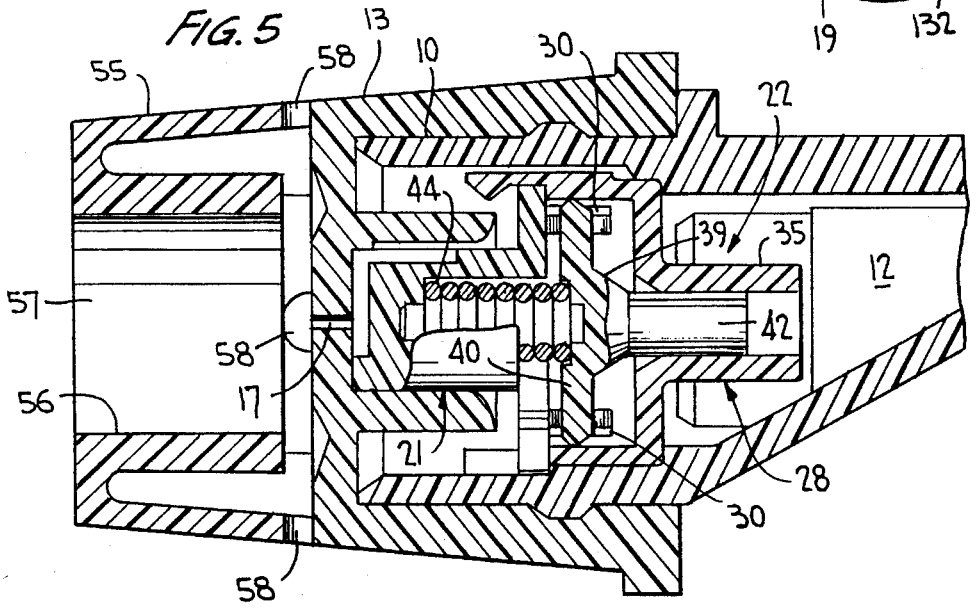
FIG. 5 is a view similar to FIG. 2 showing the discharge valve open during the pumping, and including an optional foam generator mounted at the downstream end of the nozzle cap.

At the FIG. 5 fully open flow position of the valve member, the operator's fingers are effectively caused to travel all or most of the pumping actuation stroke distance before the finger muscles can compensate and adjust to the lower force permitted by the second stage valve piston.

However, when the finger muscles adjust to the lower actuation force and relax, spring 44 immediately snaps valve member 36 closed at P2 (which is of course less than P1). At both the beginning of the piston pumping stroke and at the end of pumping actuation, the two-stage valve snaps open or snaps closed immediately thereby eliminating any formation of large fluid droplets at the beginning and end of the pumping strokes.

The unique advantage achieved by the invention is that the trigger pump regulates the operator's pumping stroke rate thus causing the fluid pressure through the spin mechanics to be constant between the beginning and the end of each pumping stroke resulting in a constant flow rate which controls the size of the spray plume and the size of the spray particles formed as the annular sheet spray breaks up in the atmosphere. The constant flow rate more importantly generates a narrow, repeatable range of spray particle size.

The pressure build-up discharge according to the invention takes place at the nozzle end of the sprayer compared to some other known sprayers providing for pressure build-up discharge at the main pump chamber from which fluid is pumped through an elongated outlet passage terminating in the nozzle.

However, without the provision of an additional discharge valve at the nozzle in such known sprayers, requiring another part increasing the cost and requiring additional assembly, the column of liquid in the outlet passage remaining after discharge shut-off at the pump chamber can leak through the discharge orifice especially when laying the pump sprayer on its side. This problem is simply and effectively avoided by the invention.

Also, discharge according to the invention as a fine mist spray having improved and uniform liquid particle size and spray velocity improves the quality of foam with the use of a foam generator such as a foaming cap 55 mounted at the downstream end of nozzle cap 13 as shown in FIG. 5. The foaming cap has, coaxial with orifice 17, an internal cylinder 56 defining a turbulence chamber 57 and a plurality of air aspiration openings 58 at the base of cap 55 for ingesting air into the fine mist spray issuing from orifice 17 as a conical spray plume. The conical spray, which may contain a foaming agent, impacts against the wall of cylinder 56 thereby creating and concentrating a foam in chamber 57 before exiting the downstream end of the chamber as a high quality foam.

Foaming cap 55 can be a separate element as shown mounted to cap 13 in a normal manner, or can be made integral with cap 13.

Foam generators of some known type other than foaming cap 55 illustrated in FIG. 5 can be utilized for generating foam within the spirit of the invention.

Many modifications and variations of the present invention are made possible in the light of the above teachings. For example, the piston/valve return spring may be of molded plastic and/or other than of coiled configuration, and may be separate or integral with one or both of parts 21, 36.

Valve piston 40 may be provided with a peripheral chevron seal in lieu of feathered peripheral edge 37, the seal extending toward end wall 29 and being of deformable material. Longitudinally extending ribs may be substituted for notches 30 for deforming the peripheral seal to break the sealing action between piston 40 and sidewall 31. Otherwise longitudinally extending grooves may be provided in sidewall 31 to break the seal.

Valve body 39 may be of spherical configuration, disc-shaped, or some other configuration, with a correspondingly shaped valve seat.

The piston guide provided by 35, 42 can be eliminated and alternately provided by rods or the like projecting from the downstream end of piston 40 sliding within holes or the like provided in flange 26. Other guide means for the piston could likewise be provided without departing from the invention.

It is therefore to be understood that within the scope of the appended claims the invention may be practiced otherwise than as specifically described.

What is claimed is:

1. A pressure build-up fluid discharge valve assembly adapted for engagement with a fluid discharge nozzle of a trigger pump sprayer, comprising:

a valve seat member having a cylinder and a valve controlled fluid flow passage therethrough;

a spinner probe member having means for imparting spin to fluid flowing through said passage, said probe member being coupled to said valve seat member;

a spring biased discharge valve element;

means within said cylinder cooperating with said valve element to establish a valve open position;

said valve element comprising a low pressure piston valve slidable within said cylinder, and an upstream directed high pressure throttle valve fixed to said piston valve and establishing for the valve seat member a predetermined pressure threshold which when exceeded by fluid pressure generated in said flow passage upon trigger actuation of the sprayer immediately opens the throttle valve and exposes said piston valve to the fluid pressure for abruptly releasing the fluid pressure at said valve open position.

2. The assembly according to claim 1, wherein said throttle valve has a projection which slidably extends within a valve guide provided on said valve seat member for guiding said valve element during movement.

3. The assembly according to claim 1, wherein said throttle valve and said piston valve have relatively small and relatively large surface areas exposed to the fluid pressure for setting a relatively high pressure drop across said throttle valve and a relatively low pressure drop across said piston valve.

4. The assembly according to claim 2, wherein longitudinal openings are defined between said projection and said valve guide.

5. The assembly according to claim 1, wherein said means within said cylinder comprises at least one notch extending through said cylinder.

6. The assembly according to claim 1, wherein said valve piston comprises a flat plate having peripheral seal means in engagement with said cylinder.

7. The assembly according to claim 1, wherein said spinner probe member has an interrupted flange for coupling said probe member to said valve seat member.

8. The assembly according to claim 1, further comprising a nozzle cap surrounding said nozzle, said cap having a discharge orifice in fluid flow communication with said spin imparting means.

9. The assembly according to claim 8, wherein said nozzle cap has foam generating means coaxial with and surrounding said orifice, said foam generating means having air aspiration openings.

10. A pressure build-up discharge valve assembly for a trigger sprayer having a discharge nozzle surrounded by a nozzle cap with a discharge orifice, the assembly being mounted within said nozzle and comprising:

a valve seat member having a cylinder and an end wall including a valve seat;

a two-stage spring biased valve element slidable within said valve seat member and comprising a throttle valve integrally connected with a second stage low pressure valve piston;

said throttle valve seating against said valve seat in a valve closed position and said valve piston sealingly engaging said cylinder in said closed position;

means in said cylinder cooperating with said valve piston for disengaging said valve piston from said cylinder to establish a fully open condition of said valve element;

said throttle valve in said closed position presenting a predetermined pressure threshold such that when such threshold is overcome by pressurized fluid generated upon trigger actuation of the sprayer said throttle valve is caused to unseat immediately to expose said piston valve to the pressurized fluid and to abruptly release the pressurized fluid as said valve piston shifts to said fully open condition.

11. The assembly according to claim 10, further comprising a spinner probe member having means for imparting spin to the pressurized fluid upon release in said fully open condition.

12. The assembly according to claim 10, wherein cooperating means are provided on said valve seat member and said valve element for guiding said valve element between said valve closed position and said fully open condition.

13. The assembly according to claim 12, wherein said cooperating means comprises a projection on said throttle valve extending into a sleeve provided on said valve seat member.

14. The assembly according to claim 13, wherein longitudinal openings are defined between said projection and said sleeve for the passage of pressurized fluid to said piston valve.

15. The assembly according to claim 10, wherein said throttle valve and said piston valve have relatively small and relatively large surface areas exposed to the pressurized fluid for establishing a relatively high pressure drop across said throttle valve and a relatively low pressure drop across said piston valve.

16. The assembly according to claim 10, wherein said means within said cylinder for establishing the valve open position comprising at least one notch in said cylinder.

17. The assembly according to claim 10, further comprising a foam generating means in said cap coaxial with and surrounding said orifice, air aspiration openings being provided in said foam generating means.

* * * * *